US010662808B2

(12) United States Patent
Clark et al.

(10) Patent No.: US 10,662,808 B2
(45) Date of Patent: May 26, 2020

(54) APPARATUS FOR CLEANING A SLOT

(71) Applicant: General Electric Company, Schenectady, NY (US)

(72) Inventors: Jason Matthew Clark, Loveland, OH (US); James Bradford Holmes, Fountain Inn, SC (US); John William Herbold, Fountain Inn, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 986 days.

(21) Appl. No.: 15/209,810

(22) Filed: Jul. 14, 2016

(65) Prior Publication Data

US 2016/0319696 A1 Nov. 3, 2016

Related U.S. Application Data

(62) Division of application No. 13/357,648, filed on Jan. 25, 2012, now abandoned.

(51) Int. Cl.

| | |
|---|---|
| ***F01D 25/00*** | (2006.01) |
| ***B08B 7/04*** | (2006.01) |
| ***B08B 1/00*** | (2006.01) |
| ***B08B 9/00*** | (2006.01) |

(52) U.S. Cl.

CPC ..... *F01D 25/002* (2013.01); *B08B 1/005* (2013.01); *B08B 1/006* (2013.01); *B08B 1/008* (2013.01); *B08B 7/04* (2013.01); *B08B 9/00* (2013.01)

(58) Field of Classification Search

CPC ..... B08B 1/003; B08B 1/005; B08B 1/006; B08B 1/008; B08B 7/04; B08B 9/00; F01D 25/002

See application file for complete search history.

(56) References Cited

U.S. PATENT DOCUMENTS

| | | | | |
|---|---|---|---|---|
| 7,412,741 | B2 * | 8/2008 | Roney | F01D 25/002 134/6 |
| 8,225,447 | B2 * | 7/2012 | Calkins, Jr. | B08B 1/04 15/21.1 |
| 10,385,724 | B2 * | 8/2019 | Vogt | B08B 1/006 |
| 2003/0086765 | A1 * | 5/2003 | Nolan | B23D 37/22 407/13 |

* cited by examiner

*Primary Examiner* — Dung Van Nguyen

(74) *Attorney, Agent, or Firm* — Dority & Manning, P.A.

(57) ABSTRACT

An apparatus for cleaning an inner surface of a slot includes a first block segment that has an outer perimeter that conforms to and fits inside the inner surface of the slot. A first cleaning pad is connected to the first block segment and extends beyond at least a portion of the outer perimeter of the first block segment.

14 Claims, 3 Drawing Sheets

APPARATUS FOR CLEANING A SLOT

RELATED APPLICATION

The present application is a divisional of and claims priority to U.S. patent application Ser. No. 13/357,648 filed on Jan. 25, 2012, which is incorporated herein by reference in its entirety.

FIELD OF THE INVENTION

The present invention generally involves an apparatus for cleaning a slot. In particular embodiments, the apparatus may be used to clean, for example, an inner surface of a dovetail slot in a rotor wheel.

BACKGROUND OF THE INVENTION

Gas turbines are widely used in industrial and commercial operations. For example, a typical commercial gas turbine used to generate electrical power includes a compressor at the front, one or more combustors around the middle, and a turbine at the rear. The compressor generally includes alternating stages of stator vanes and rotating blades as is known in the art. Ambient air enters the compressor as a working fluid, and the compressor progressively imparts kinetic energy to the working fluid to produce a compressed working fluid at a highly energized state. The compressed working fluid exits the compressor and flows to the combustors where it mixes with fuel and ignites to generate combustion gases having a high temperature and pressure. The turbine generally includes alternating stages of stator vanes and rotating blades. The stator vanes may be attached to a stationary component such as a casing that surrounds the turbine, and the rotating blades may be attached to a rotor located along an axial centerline of the turbine. The combustion gases flow through the turbine where they expand to produce work.

The rotor in the gas turbine may actually include a number of rotor wheels connected together to facilitate manufacture and assembly of the rotor. In the turbine section, the rotor wheels may include dovetail slots circumferentially arranged around the rotor wheel to receive complementary dovetail extensions of the rotating blades. Periodically, the rotating blades are removed, and the dovetail slots are cleaned of all residue, deposits, and debris to facilitate non-destructive testing of the rotor wheels.

Various systems and methods are known in the art for cleaning the dovetail slots prior to the non-destructive testing. For example, dry ice blasting and/or commercially available abrasive pads may be used clean the dovetail slots. However, the various efforts often result in incomplete and/or inconsistent cleaning that must be resolved before the non-destructive testing can proceed. As a result, an improved apparatus for cleaning dovetail slots in the rotor wheels would be useful.

BRIEF DESCRIPTION OF THE INVENTION

Aspects and advantages of the invention are set forth below in the following description, or may be obvious from the description, or may be learned through practice of the invention.

One embodiment of the present invention is an apparatus for cleaning an inner surface of a slot. The apparatus includes a first block segment that has an outer perimeter that conforms to and fits inside the inner surface of the slot.

A first cleaning pad is connected to the first block segment and extends beyond at least a portion of the outer perimeter of the first block segment.

Another embodiment of the present invention is an apparatus for cleaning an inner surface of a slot that includes a plurality of block segments adjacent to one another, wherein each block segment has an outer perimeter that conforms to and fits inside the inner surface of the slot. A cleaning pad is sandwiched between a first pair of adjacent block segments and extends beyond at least a portion of the outer perimeters of the first pair of adjacent block segments.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
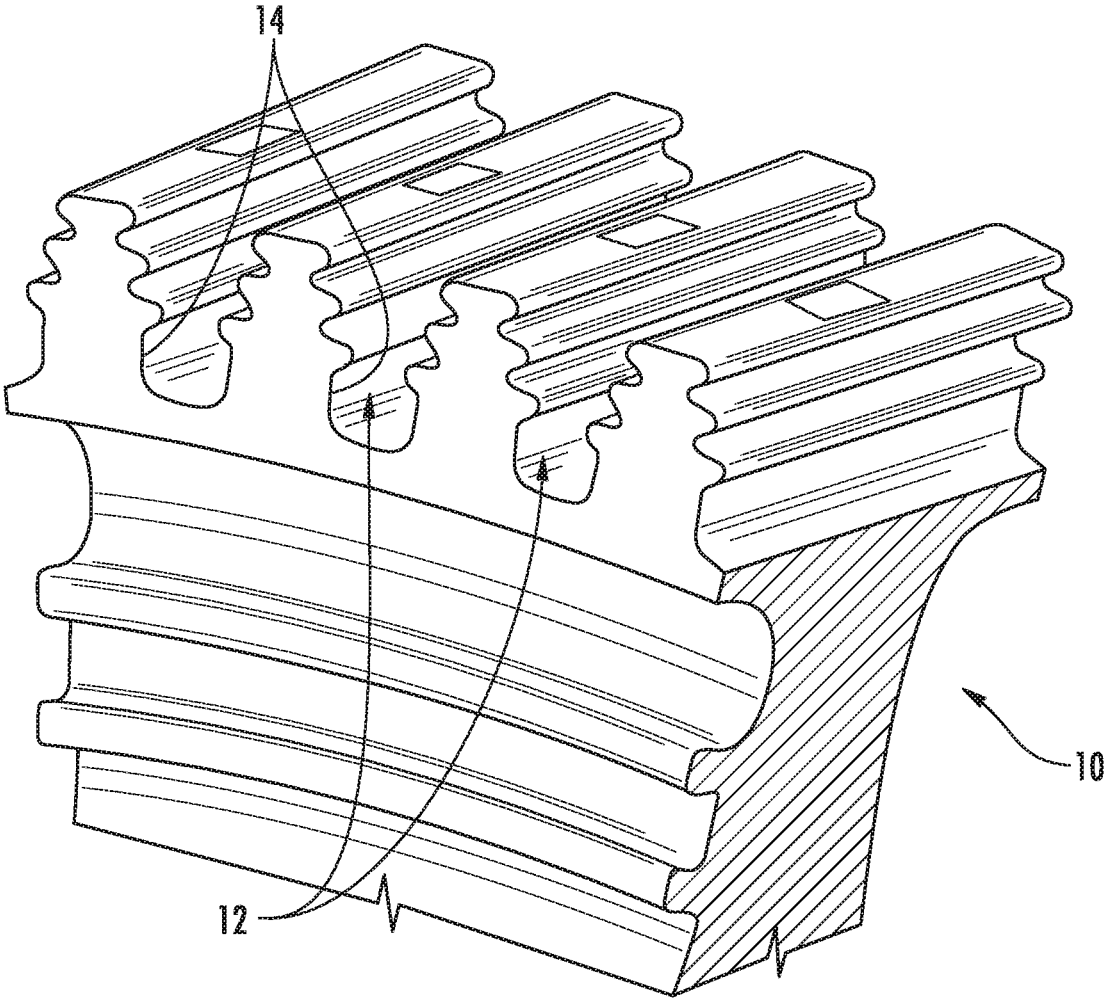
FIG. 1 is a perspective view of a portion of an exemplary rotor wheel.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include an apparatus for cleaning a dovetail slot in a rotor wheel. The apparatus generally includes a combination of one or more cleaning pads and/or wipers connected to one or more block segments, and in particular embodiments, the cleaning pads and/or wipers may be sandwiched between the block segments. The block segments are sized slightly smaller than the dovetail slot, and the cleaning pads and/or wipers are slightly oversized to extend beyond at least a portion of the block segments to create an interference fit between the block segments and the dovetail slot. An articulated handle may be connected to one or more of the block segments to facilitate manipulation of the apparatus in confined spaces. In this manner, the cleaning pads and/or wipers may be inserted into the dovetail slot to abrasively clean and/or wipe the dovetail slot. Although exemplary embodiments of the present invention will be described generally in the context of a rotor wheel incorporated into a gas turbine for purposes of illustration, one of ordinary skill in the art will readily appreciate that embodiments of the present invention may be applied to clean any slot and are not limited to a gas turbine or other turbo-machine rotor wheel unless specifically recited in the claims.

FIG. 1 provides a perspective view of a portion of an exemplary rotor wheel 10, such as may be incorporated into a gas turbine or other turbo-machine. As shown, a plurality of dovetail slots 12 are circumferentially arranged around the rotor wheel 10 to receive complementary dovetail extensions of rotating blades (not shown). Each dovetail slot 12 may include one or more grooves or ridges along an inner surface 14 to enhance retention of the rotating blades during operations. However, one of ordinary skill in the art will readily appreciate that the various embodiments of the present invention may be used with dovetail slots 12 having different inner surfaces 14, and the various embodiments of the present invention are not limited to any particular shape or configuration of the inner surface 14 of the dovetail slots 12 unless specifically recited in the claims.

Figure 2:
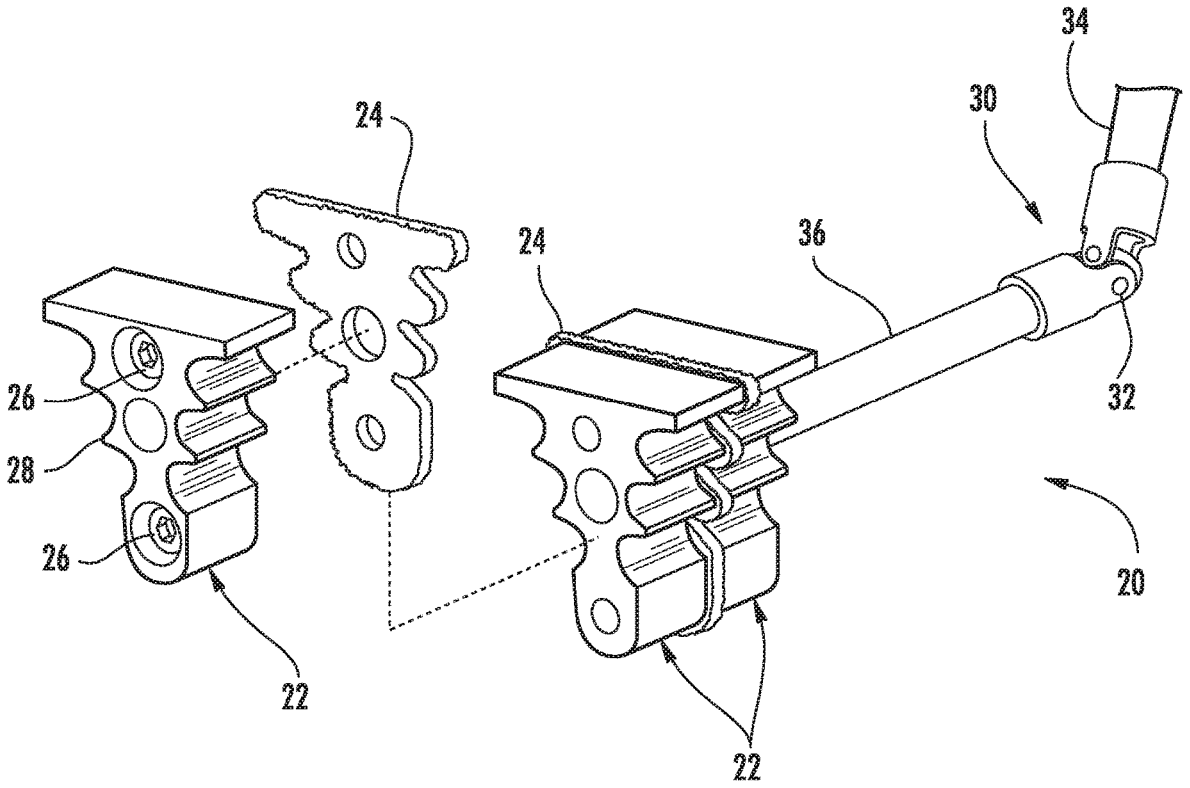
FIG. 2 is a perspective, partially exploded view of an apparatus for cleaning a dovetail slot in a rotor wheel according to a first embodiment of the present invention.

FIG. 2 provides a perspective, partially exploded view of an apparatus 20 for cleaning the inner surface 14 of the dovetail slots 12 shown in FIG. 1 according to a first embodiment of the present invention. As shown, the apparatus 20 may include a plurality of block segments 22 and cleaning pads 24. The block segments 22 provide the general shape and structure for the apparatus 20 and may be made from any non-marring and rigid material capable of repeated handling and abrasive contact with the inner surface 14 of the dovetail slots 12. For example, the block segments 22 may be made from wood, plastic, fiberglass, metal, or other suitably durable materials. The cleaning pads 24 generally provide an abrasive surface between the block segments 22 and the inner surface 14 of the dovetail slots 12 to facilitate removal of residue, deposits, and other debris from the inner surface 14 of the dovetail slots 12. The cleaning pads 24 may be cut, for example, from an abrasive media such as Scotch-Brite® pads made and sold by Minnesota Mining and Manufacturing Company. However, other types of abrasive media may be utilized, and the present invention is not limited to any particular material for cleaning pads 24 unless specifically recited in the claims.

The block segments 22 may be connected adjacent to one another, and the cleaning pads 24 may be connected to one or more of the block segments 22. For example, as shown in FIG. 2, a bolt 26 may pass through the block segments 22 and cleaning pads 24 to hold the block segments 22 together and sandwich each cleaning pad 24 between a pair of adjacent block segments 22. Each block segment 22 has an outer perimeter 28 that generally matches or conforms to and fits inside the inner surface 14 of the dovetail slot 12. In addition, in the particular embodiment shown in FIG. 2, each cleaning pad 24 is sized slightly larger than the block segments 22 or dovetail slot 12 so that each cleaning pad 24 extends beyond the outer perimeter 28 of the block segments 22 at all points around the outer perimeter 28 of the block segments 22. The cleaning pads 24 provide an interference fit between the bock segments 22 and the inner surface 24 of the dovetail slot 12 to enhance abrasive removal of residue, deposits, and debris from the dovetail slot 12. As a result, the cleaning pads 24 may be consumed during the cleaning process, and replacement cleaning pads 24 may be water jet cut and available for replacement as required.

As further shown in FIG. 2, the apparatus 20 may further include an articulated handle 30 connected to one or more of the block segments 22. As used herein, "articulated" means having two or more sections connected by a flexible joint. For example, in the particular embodiment shown in FIG. 2, the articulated handle 30 includes a ball or universal joint 32 between first and second handle segments 34, 36 to allow the first handle segment 34 to rotate in multiple directions with respect to the second handle segment 36. In this manner, the articulated handle 30 facilitates axial manipulation of the apparatus 20 with respect to the dovetail slot 12 in confined spaces.

To clean the dovetail slot 12, a user inserts the block segments 22 and cleaning pads 24 axially into the dovetail slot 12 of the rotor wheel 10 and alternately pushes or pulls the apparatus 20. In doing so, the cleaning pads 24 sandwiched between the block segments 22 will abrade the inner surface 14 of the dovetail slot 12 to break free residue, deposits, and debris from the inner surface 14 of the dovetail slot 12. Once the residue, deposits, and debris are sufficiently loosened, the cleaning pads will push the loosened materials out of the dovetail slot 12.

Figure 3:
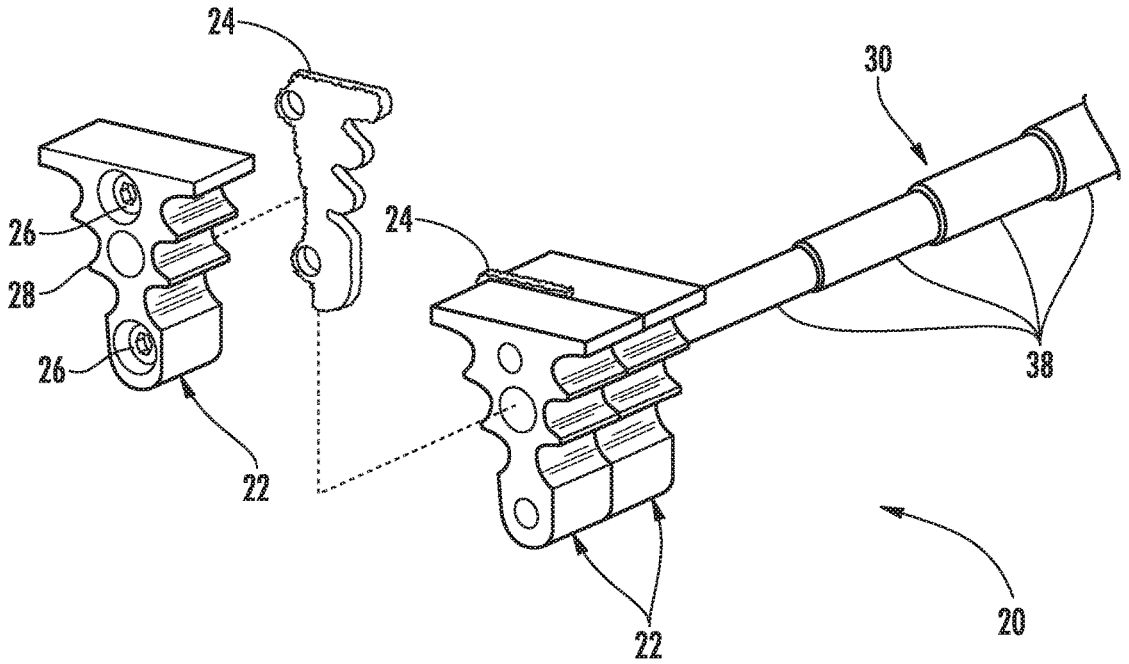
FIG. 3 is a perspective, partially exploded view of an apparatus for cleaning a dovetail slot in a rotor wheel according to a second embodiment of the present invention.

FIG. 3 provides a perspective, partially exploded view of an apparatus 20 for cleaning the inner surface 14 of the dovetail slots 12 shown in FIG. 1 according to a second embodiment of the present invention. The apparatus 20 again includes block segments 22 as previously described with respect to the embodiment shown in FIG. 2. In this particular embodiment, however, the cleaning pads 24 previously described with respect to FIG. 2 have been cut in half, with each half sandwiched between adjacent block segments 22 in a staggered or alternating pattern. In this manner, each cleaning pad 24 extends beyond only a portion of the outer perimeter 28 of the block segments 22 on alternating sides of the block segments 22. This staggered or alternating pattern of cleaning pads 24 with respect to the block segments 22 may be useful, for example, when the clearance between the block segments 22 and the dovetail slot 12 is particularly close. As further shown in FIG. 3, the articulated handle 30 in this particular embodiment includes multiple handle segments 38 that telescope within one another to alternately extend or retract the block segments 22 inside the dovetail slot 12.

Figure 4:
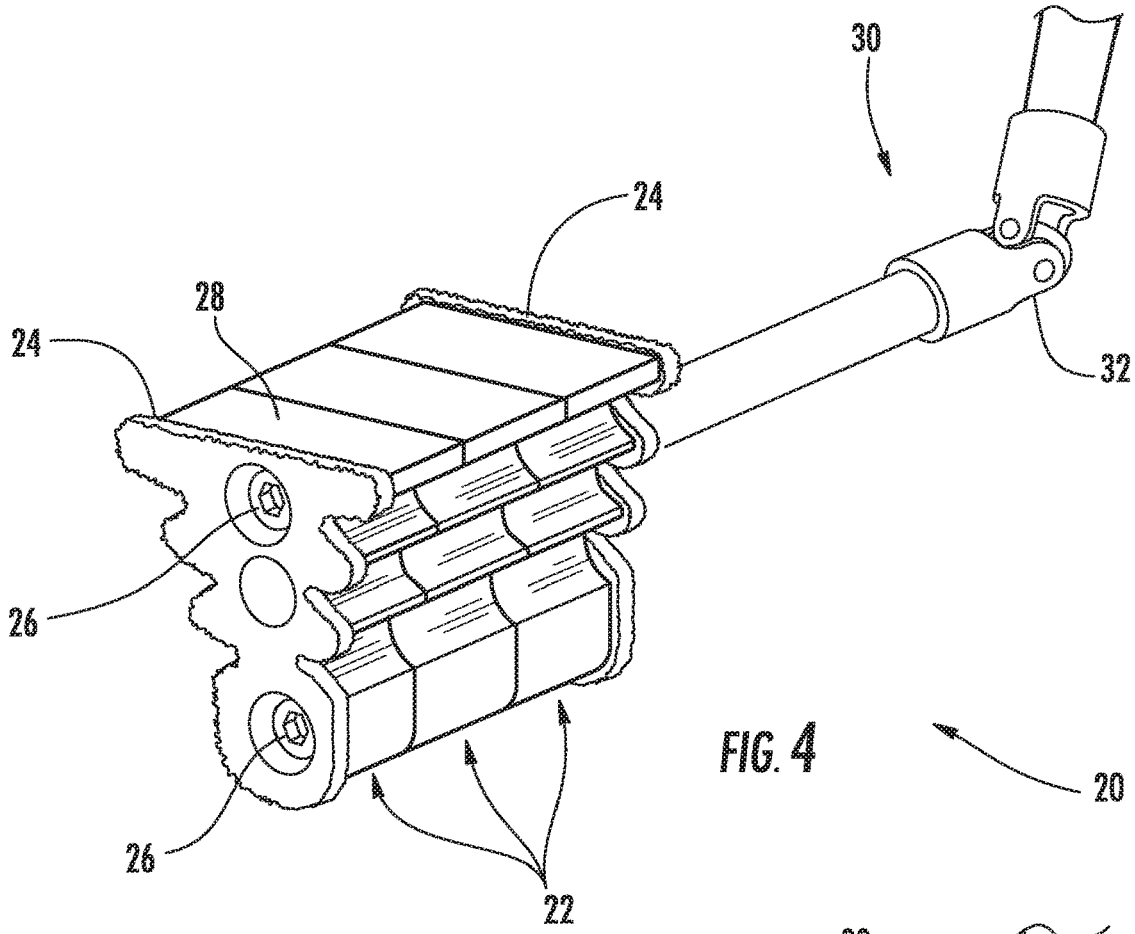
FIG. 4 is a perspective view of an apparatus for cleaning a dovetail slot in a rotor wheel according to a third embodiment of the present invention.

FIG. 4 provides is a perspective view of an apparatus 20 for cleaning the inner surface 14 of the dovetail slots 12 shown in FIG. 1 according to a third embodiment of the present invention. The apparatus 20 again includes the block segment 22, cleaning pads 24, and articulated handle 30 as previously described with respect to the embodiment shown in FIG. 2. In this particular embodiment, however, the apparatus 20 includes only a single block segment 22, and the cleaning pads 24 previously described with respect to FIG. 2 are connected to opposite ends of the block segment 22. In this arrangement, each cleaning pad 24 again extends beyond the outer perimeter 28 of the block segment 22 at all points around the outer perimeter 28 of the block segment 22. However, each cleaning pad 24 is primarily effective at abrading the inner surface 14 of the dovetail slot 12 in only a single direction. Specifically, the cleaning pad 24 on the leading edge of the block segment 22 will be more effective at abrading the inner surface 14 of the dovetail slot 12 as the user inserts the block segment 22 into the dovetail slot 12 and pushes the block segment 22 through the dovetail slot 12. Once the user has pushed the block segment 22 completely through the dovetail slot 12, the cleaning pad 24 on the trailing edge of the block segment 22 will be more effective at abrading the inner surface 14 of the dovetail slot 12 as the user pulls the block segment 22 back through the dovetail slot 12 in the opposite direction.

Figure 5:
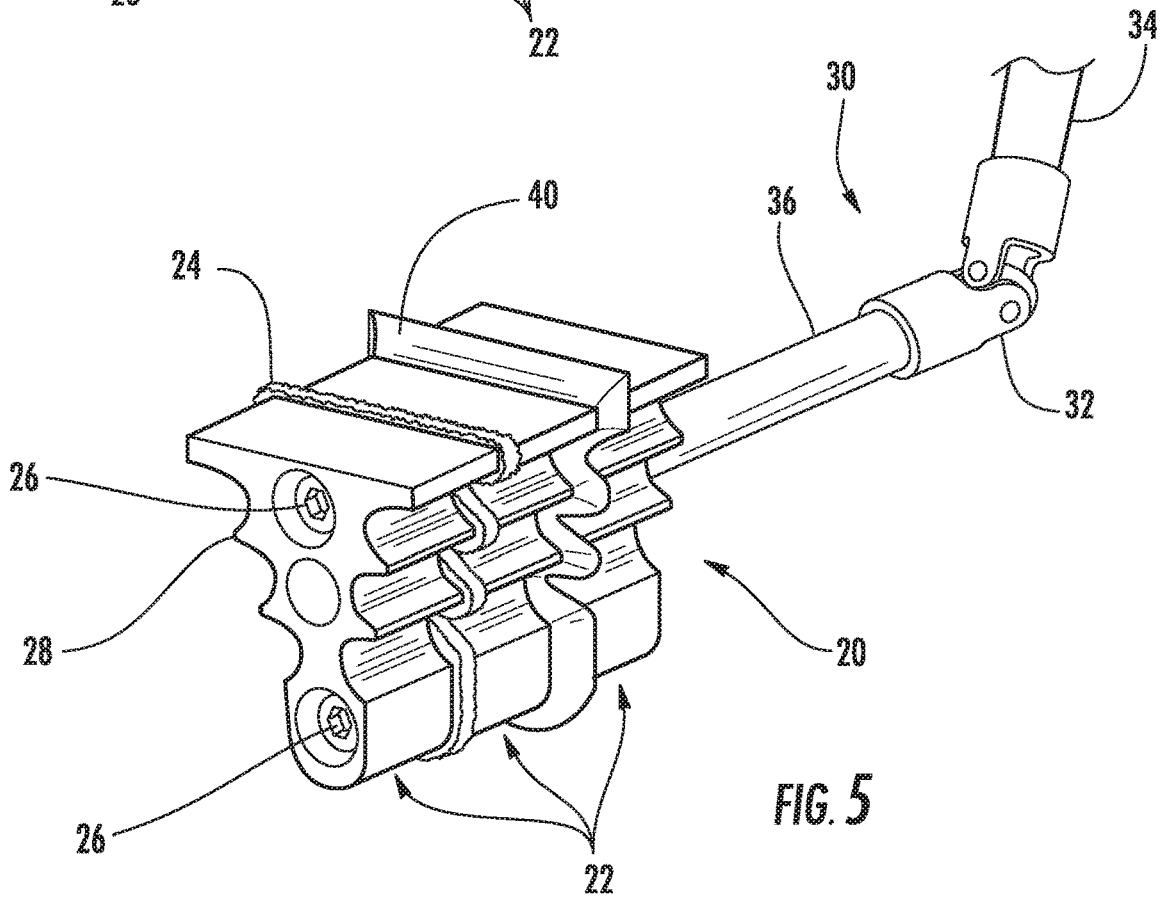
FIG. 5 is a perspective view of an apparatus for cleaning a dovetail slot in a rotor wheel according to a fourth embodiment of the present invention.

FIG. 5 provides is a perspective view of an apparatus 20 for cleaning the inner surface 14 of the dovetail slots 12 shown in FIG. 1 according to a fourth embodiment of the present invention. The apparatus 20 again includes multiple block segments 22, at least one cleaning pad 24 sandwiched between adjacent block segments 22, and the articulated handle 30 as previously described with respect to the embodiment shown in FIG. 2. In addition, the apparatus 20 also includes a wiper 40 connected to at least one of the block segments 22 and extending beyond at least a portion of the outer perimeter 28 of the block segment 22. In the particular embodiment shown in FIG. 5, the wiper 40 is sandwiched between a pair of adjacent block segments 22 and extends beyond the outer perimeter 28 of the block segments 22 at all points around the outer perimeter 28 of the block segments 22. The wiper 40 may be made from rubber, latex, silicone, polytetrafluoroethylene (PTFE), or other resilient material suitable for wiping the inner surface 14 of the dovetail slot 12. In this manner, as the user alternately pushes or pulls the block segments 22 inside the dovetail slot 12, the cleaning pad 24 may abrade the inner surface 14 of the dovetail slot 12 while the wiper 40 simultaneously cleans the loosened residue, deposits, and debris from inside the dovetail slot 12.

Based on the preceding disclosure and embodiments shown in FIGS. 2-5, one of ordinary skill in the art will readily appreciate that the various embodiments described herein may significantly reduce critical path cycle time during non-destructive testing of rotor wheels. For example, the embodiments within the scope of the present invention do not require multiple resources to hand clean the dovetail slot 12 after dry ice blasting. In addition, the embodiments within the scope of the present invention may be used by the same operators who will perform the non-destructive testing, thus reducing the need for a third party vendor and the additional costs associated with a third party vendor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An apparatus for cleaning an inner surface of a rotor wheel slot, comprising:

a first block segment, a second block segment and a third block segment coupled together, wherein the first block segment, the second block segment and the third block segment respectively have a dovetail shaped outer perimeter that is complementary to the inner surface of the rotor wheel slot;

a first cleaning pad sandwiched between the first block segment and the second block segment, wherein the first cleaning pad extends beyond at least a portion of the outer perimeter of the first block segment and the second block segment; and a second cleaning pad coupled to the third block segment, wherein the second cleaning pad extends beyond at least a portion of the outer perimeter of the third block segment.

2. The apparatus as in claim 1, wherein the second cleaning pad is sandwiched between the second block segment and the third block segment.

3. The apparatus as in claim 1, Wherein the first cleaning pad extends beyond the outer perimeter of the first block segment and the second block segment at all points around the outer perimeter of the first block segment and the outer perimeter of the second block segment.

4. The apparatus as in claim 1, further comprising a wiper connected to the third block segment, wherein the wiper extends beyond at least a portion of the outer perimeter of the third block segment.

5. The apparatus as in claim 4, wherein the wiper is sandwiched between the second and third block segments.

6. The apparatus as in claim 4, wherein the wiper extends beyond the outer perimeter of the third block segment at all points around the outer perimeter of the third block segment.

7. An apparatus for cleaning an inner surface of a turbine rotor wheel slot, comprising:

a plurality of block segments coupled together, wherein each block segment has a rigid outer perimeter that is complementary to and fits inside the inner surface of the turbine rotor wheel slot; and a first cleaning pad sandwiched between a first pair of adjacent block segments, wherein the first cleaning pad extends beyond at least a portion of the outer perimeters of the first pair of adjacent block segments.

8. The apparatus as in claim 7, wherein the first cleaning pad extends beyond the outer perimeters of the first pair of adjacent block segments at all points around the outer perimeters of the first pair of adjacent block segments.

9. The apparatus as in claim 7, further comprising an articulated handle connected to at least one block segment of the plurality of block segments.

10. The apparatus as in claim 7, further comprising a second cleaning pad sandwiched between a second pair of adjacent block segments of the plurality of block segments, wherein the second cleaning pad extends beyond at least a portion of the respective outer perimeters of the second pair of adjacent block segments.

11. The apparatus as in claim 7, further comprising a wiper connected to at least one block segment, wherein the wiper extends beyond at least a portion of the outer perimeter of the at least one block segment.

12. The apparatus as in claim 11, wherein the wiper is sandwiched between a second pair of adjacent block segments of the plurality of block segments.

13. The apparatus as in claim 11 wherein the wiper extends beyond the outer perimeter of the at least one block segment at all points around the outer perimeter of the at least one block segment.

14. The apparatus as in claim 11, wherein said outer perimeter of each said block segment conforms to and fits inside the inner surface of a dovetail slot in a rotor wheel.

* * * * *